US005961099A

United States Patent [19]

Thommen, Jr.

[11] Patent Number: 5,961,099

[45] Date of Patent: Oct. 5, 1999

[54] SAFETY NET SYSTEM FOR DEBRIS AND MUD SLIDES

[75] Inventor: Robert A. Thommen, Jr., Santa Fe, N.Mex.

[73] Assignee: Brugg Cable Products, Inc., Santa Fe, N.Mex.

[21] Appl. No.: 09/012,781

[22] Filed: Jan. 23, 1998

[51] Int. Cl.[6] ..... E01F 7/00

[52] U.S. Cl. ..... 256/12.5; 256/35; 256/45

[58] Field of Search ..... 256/12.5, 35, 24, 256/31, 32, 45, 47

[56] References Cited

U.S. PATENT DOCUMENTS

| | | | |
|---|---|---|---|
| 571,491 | 11/1896 | Mason | 256/35 X |
| 1,828,350 | 10/1931 | Williams . | |
| 3,347,527 | 10/1967 | Andrews | 256/24 X |
| 4,730,810 | 3/1988 | Rambaud . | |
| 4,819,915 | 4/1989 | Cargnel . | |
| 5,207,302 | 5/1993 | Popp et al. | 256/12.5 X |
| 5,299,781 | 4/1994 | Barrett et al. | 256/12.5 |
| 5,395,105 | 3/1995 | Thommen, Jr. . | |
| 5,435,524 | 7/1995 | Ingram | 256/12.5 |
| 5,524,875 | 6/1996 | Thommen, Jr. . | |
| 5,732,935 | 3/1998 | Codario, Jr. | 256/31 X |

FOREIGN PATENT DOCUMENTS

| | | |
|---|---|---|
| 2414586 | 8/1979 | France . |
| 2622611 | 5/1989 | France . |
| 2919582 | 11/1980 | Germany . |
| 3602787 | 8/1987 | Germany . |

*Primary Examiner*—Lynne Reichard
*Assistant Examiner*—John R. Cottingham
*Attorney, Agent, or Firm*—Robert W. Becker & Associates

[57] ABSTRACT

A safety net system that is placed upright on the ground for restraining mud and debris slides is provided. The system includes at least one unit, each of which comprises at least one net panel that is disposed between two columns and is secured to continuous top and bottom ropes. The top rope extends from the bottom of one end column of a unit, through a guide at the top of that end column, through respective top guides of any interposed columns, through the top guide of the other end column, to a bottom end of that other end column. The bottom rope extends from the bottom end of one end column, through respective guides near the bottom of any interposed columns, to the bottom end of the other end column. Anchors are disposed laterally of each end column and uphill of each of the columns. Bracing cables extend from both the upper and bottom ends of each end column to the lateral anchors, and further bracing cables extend from both the upper and bottom ends of each of the columns to the uphill anchors.

20 Claims, 12 Drawing Sheets

SAFETY NET SYSTEM FOR DEBRIS AND MUD SLIDES

BACKGROUND OF THE INVENTION

The present invention relates to a safety net system that is placed upright on the ground for restraining debris slides, such as mud slides.

A number of barriers for restraining falling rocks are known. For example, in U.S. Pat. No. 4,819,915, Cargnel, a flexible barrier is disclosed that is provided with posts that pivot on a ground-anchored base plate, with the posts being held by wind bracing cables, some of which extend in an upstream direction and others of which extend in a downstream direction. An arresting net is secured to a series of spaced-apart horizontal ropes that are supported by the upstream wind bracing cable. U.S. Pat. No. 4,730,810, Rambaud, discloses a protective barrier that comprises a sheet of netting that is held upright by posts that in turn are held by upstream and downstream stays that are coupled to guide means that are further coupled to a mooring cable and to shock-absorbing means. U.S. Pat. Nos. 5,395,105 and 5,524,875, both to Thommen, disclose low impact restraining systems. Unfortunately, these systems are not suitable for mud and debris slides, where the force is anywhere from 2 to 10 times as great as that of a low-impact rock slide.

It is therefore an object of the present invention to provide a safety net system for mud and debris slides that is extremely effective, requires little maintenance, and is also economical.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The safety net system of the present invention includes at least one unit, each of which comprises at least one net panel. Each net panel is disposed between two columns that are disposed in or on the ground. Each net panel, which is not secured to the columns, is rather secured to top and bottom ropes, and in particular to a continuous top rope that extends from the bottom end of an end column of one of the units, through guide means at the top of that end column, through respective guide means of any intermediate or interposed columns, through guide means at the top of the other end column of that unit, to a bottom end of the other end column of that unit; the bottom rope is a continuous rope that extends from the bottom end of one of the end columns, through respective guide means near the bottom ends of any interposed columns, to the bottom end of the other end column of the unit. Anchor means are disposed both laterally of each end column, and uphill of each of the columns, wherein bracing cables that extend from both the upper and bottom ends of each of the end columns extend to the lateral anchor means, and further bracing cables extend from both the upper and bottom ends of each of the columns to the uphill anchor means.

Further specific features of the inventive safety net system will be described in detail subsequently.

DETAILED OF PREFERRED EMBODIMENTS

Figure 1:
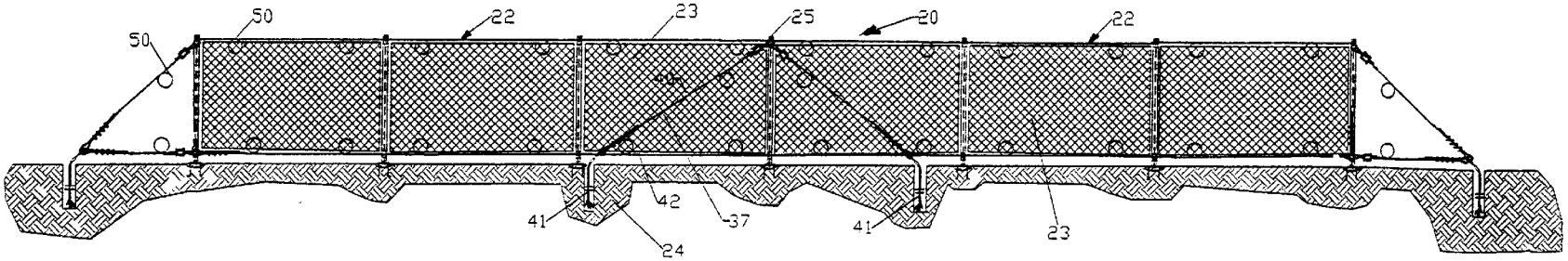
FIG. 1 illustrates one exemplary embodiment of the inventive safety net system.

Referring now to the drawings in detail, FIG. 1 shows one exemplary embodiment of the inventive safety net system, which is indicated generally by the reference numeral 20. In the illustrated embodiment, the safety net system 20 is shown as being comprised of two units 22, each of which includes several net panels 23, which will be described in detail subsequently. In addition, each unit 22 is anchored in a very specific manner, as will also be described in detail subsequently.

Figure 2:
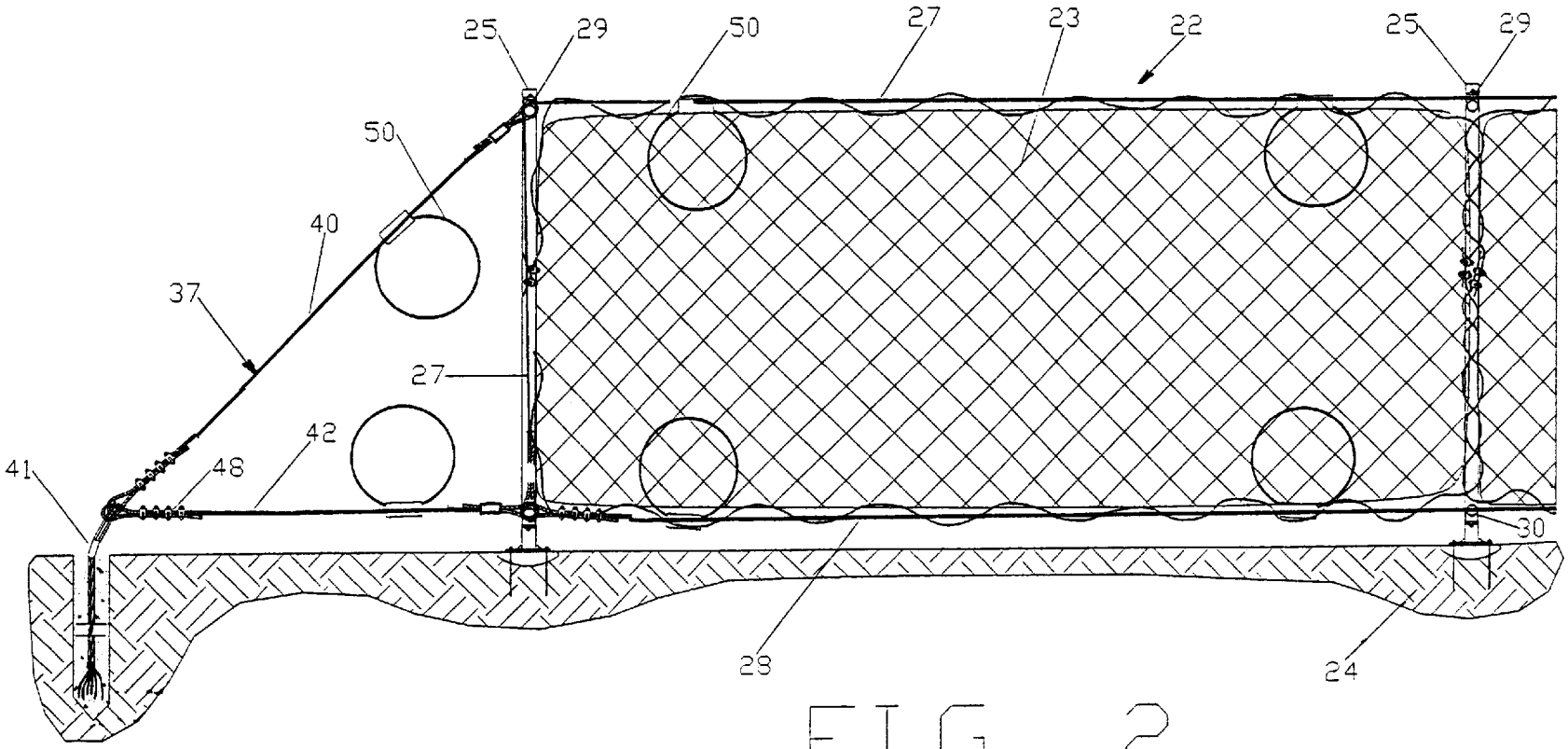
FIG. 2 is an end view of the system of FIG. 1.
Figure 3:
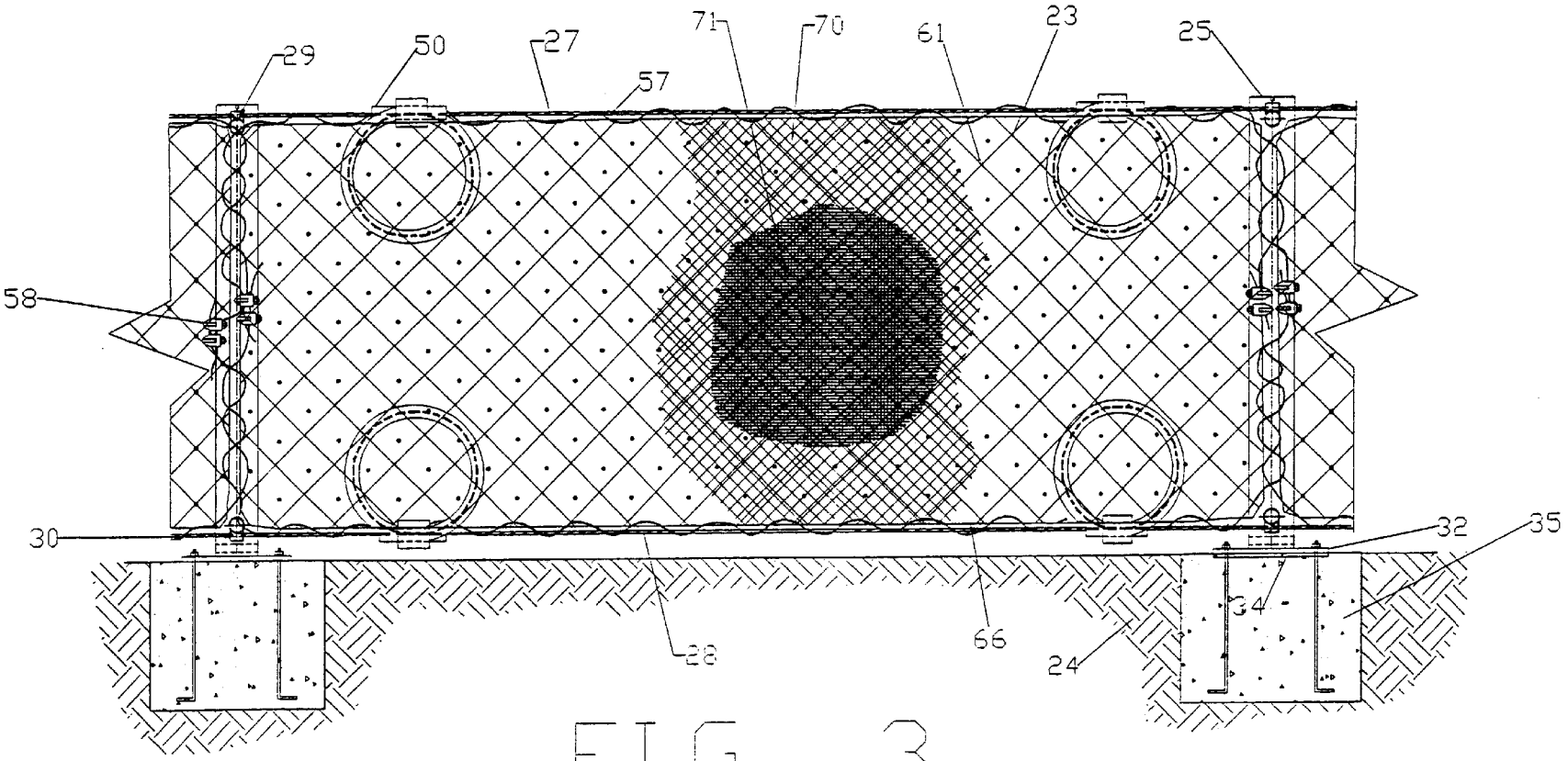
FIG. 3 is a detailed view of one of the net panels of the system of FIG. 1, and also illustrates how adjacent net panels are seamed together.

The construction of each unit 22, which comprises at least one net panel 23, which is preferably a woven net panel, will now be described in conjunction with some of the more detailed figures. For example, FIG. 2 illustrates an end net panel 23 of a unit 22 of the inventive safety net system 20, while FIG. 3 shows an intermediate net panel 23 of one exemplary embodiment of the inventive safety net system 20. The drawings show how the safety net system is placed upright on the ground or bedrock 24.

In FIG. 2, an enlarged end view of the second or downhill-facing side is shown. The net panel 23 is disposed between two columns 25, for example structural steel columns, which are disposed upright at least indirectly in the ground or bedrock 24. The net panel 23 is held in place in a manner to be described in detail subsequently. A top rope 27 extends continuously from near the bottom of one end column 25, where it is secured in a convenient manner, all the way to the bottom of the other end column 25 of a given unit 22 of the safety net system 20. Similarly, a bottom rope 28 extends continuously from the bottom of one of the end columns 25 of a given unit 22 to the other end column 25 thereof. In particular, the continuous top rope 27 extends from the bottom of a given end column 25, where it is secured, then to the top of that column, where it extends through a guide means 29, then extends along the top of the unit 22 through respective guide means at the top of any interposed or intermediate columns 25, then extends through the guide means 29 of the other end column 25, and finally extends to the bottom end of this other end column 25, where it is also secured (see FIGS. 2 and 3). The continuous bottom rope 28, on the other hand, extends from the bottom end of one of the end columns 25, where it is secured, through respective guide means 30 provided near the bottom ends of any interposed columns 25, to the bottom end of the other end column 25 of the unit 22, where it is also secured.

Figure 4:
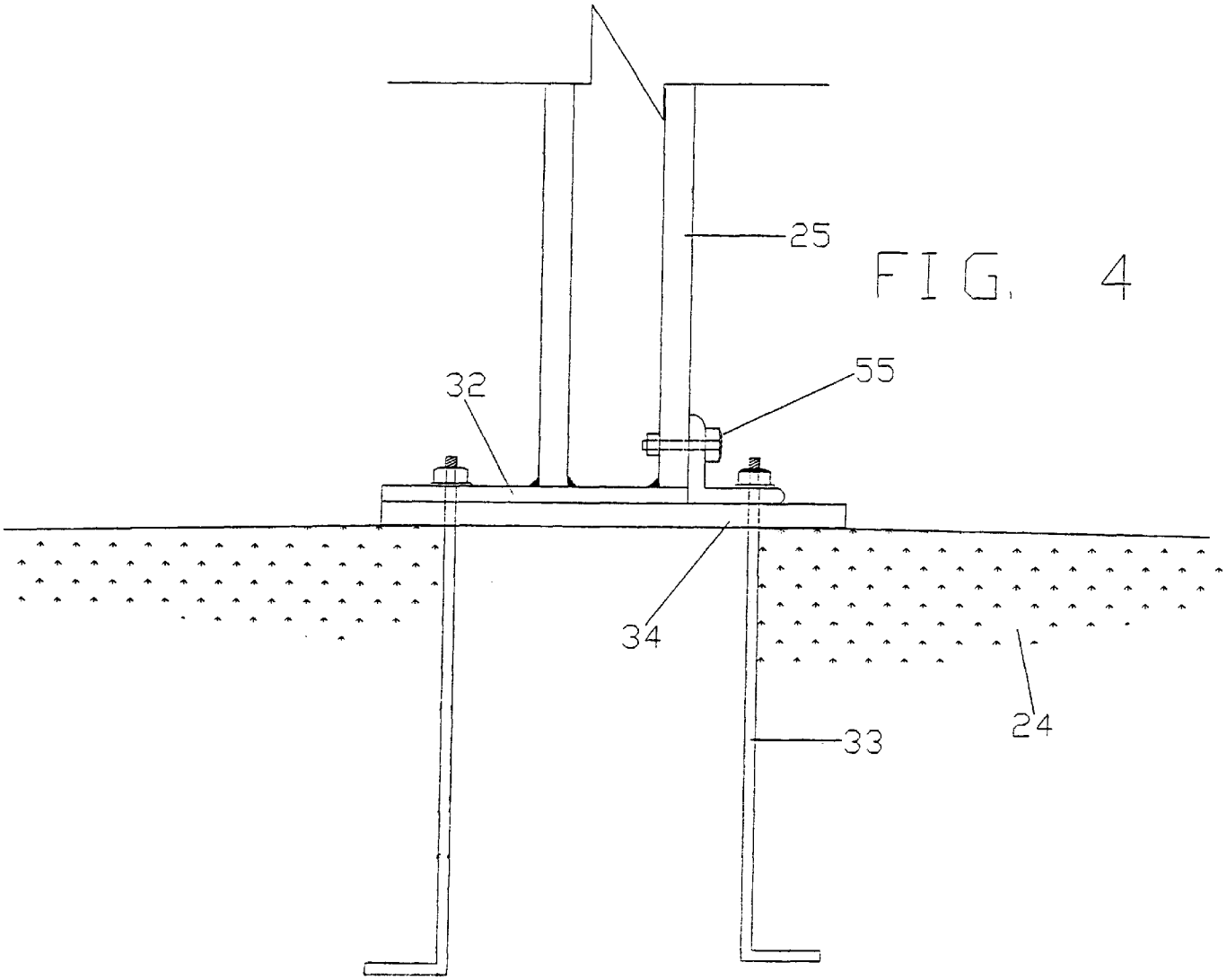
FIG. 4 is a detailed view showing one exemplary embodiment for anchoring a column of the inventive safety net system.

The columns 25 are preferably profiled, having for example an H-shaped cross-sectional configuration. The columns themselves are disposed on or in the ground in a number of different ways. For example, as shown in particular in FIGS. 3 and 4, the column 25 can be connected to a base plate 32, which is then secured directly to anchor bolts 33 that are disposed in the ground 24, or can be bolted to a further base plate 34 that is itself secured in the ground by the anchor bolts 33. Such anchor bolts can either be disposed directly in the ground or bedrock 24, or can be secured in poured concrete 35, as illustrated in FIG. 3. It would also be possible to dispose the column 25 in a hole that is then filled with concrete. Any other convenient manner for disposing the columns 25 on or in the ground could, of course, also be utilized.

Figure 5A:
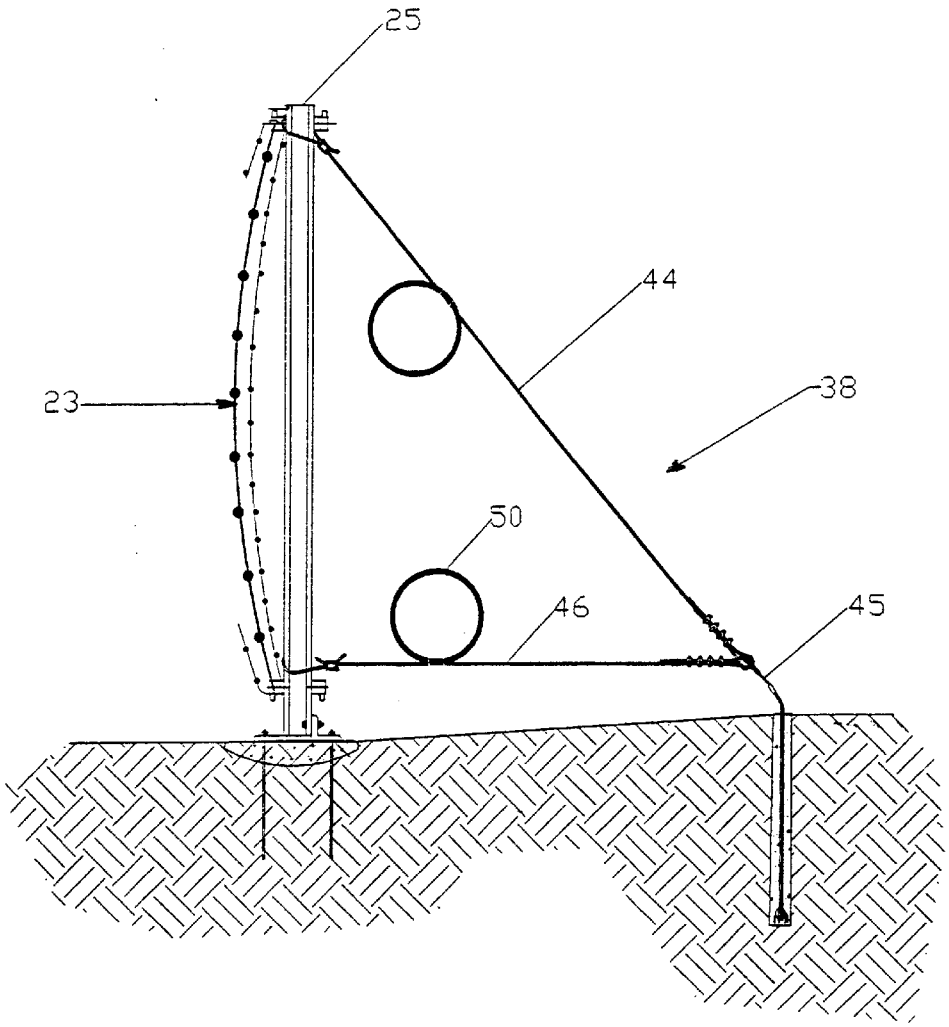
FIGS. 5*a*, 5*b*, 6*a*, and 6*b* show the various bracing cables and anchor means for the columns of the inventive safety net system.
Figure 5B:
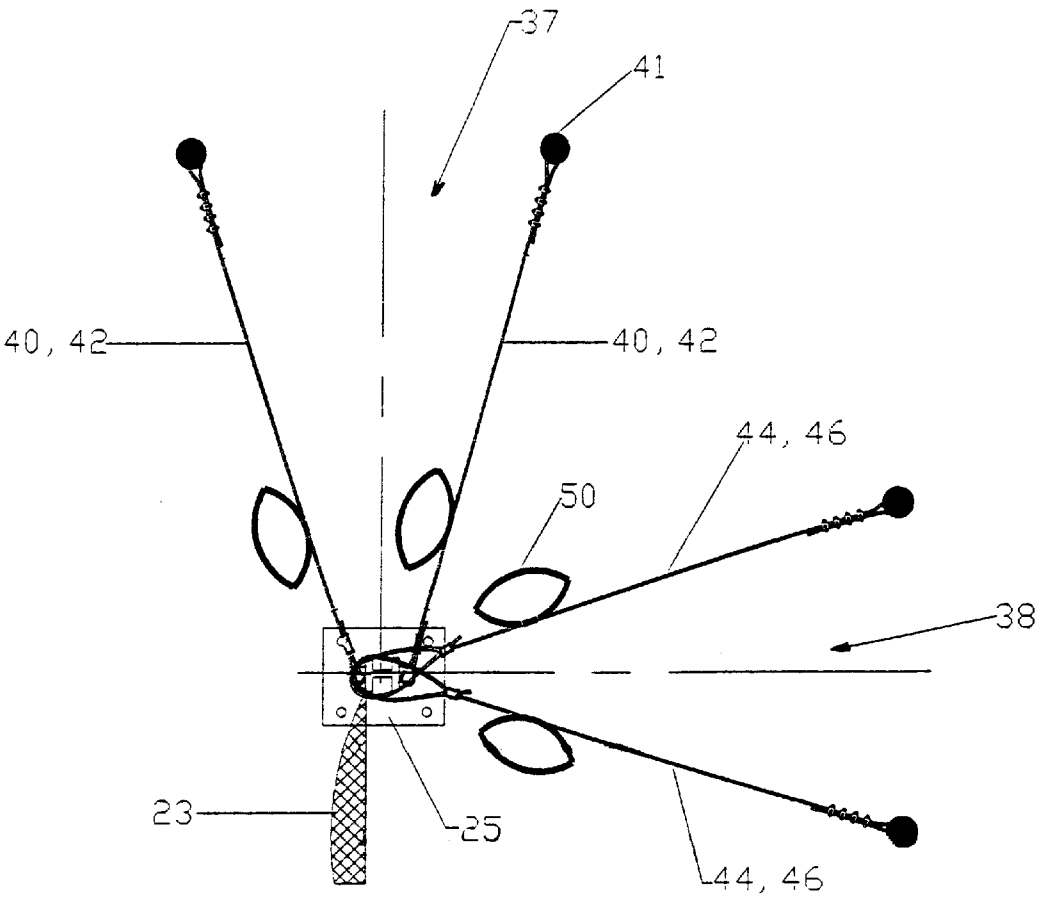
Figure 6A:
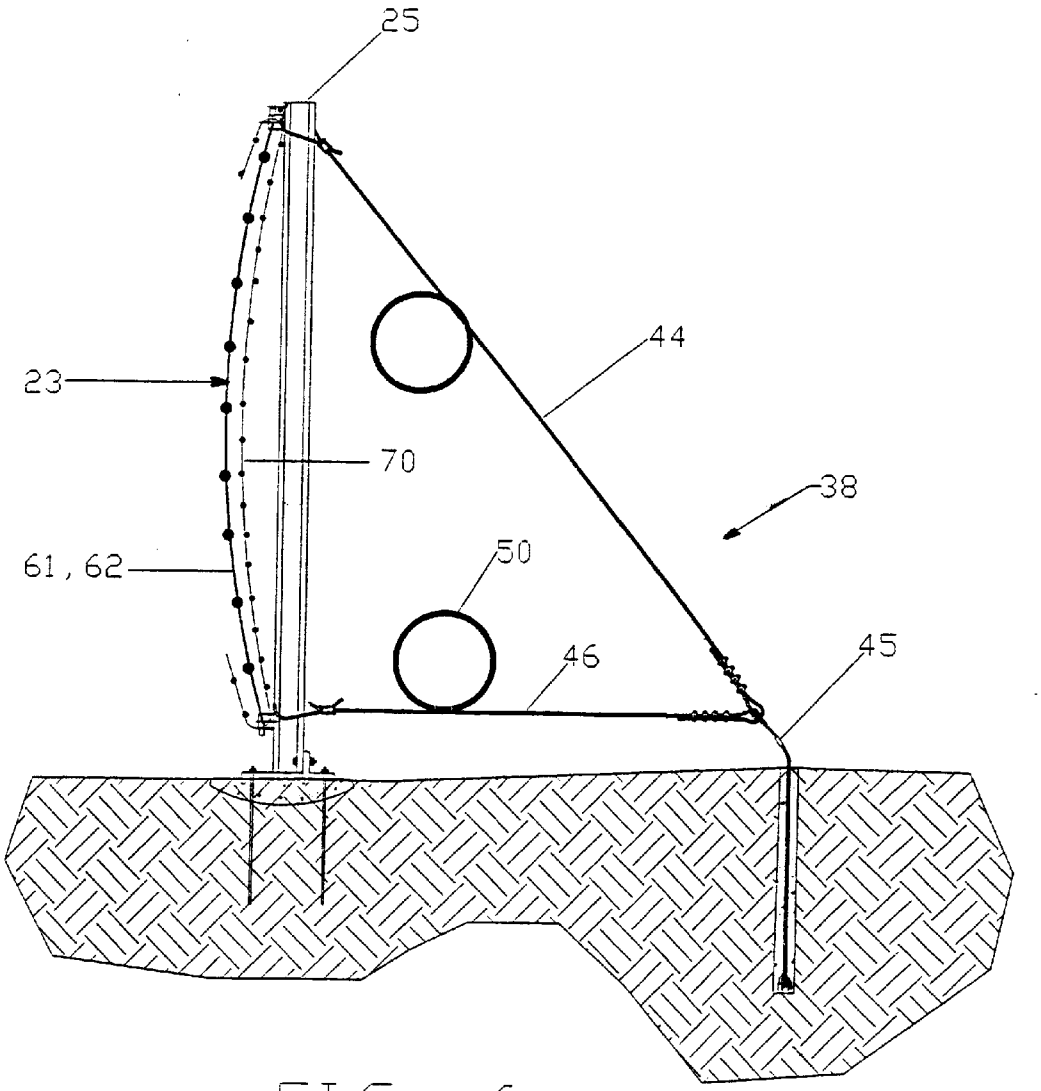
Figure 6B:
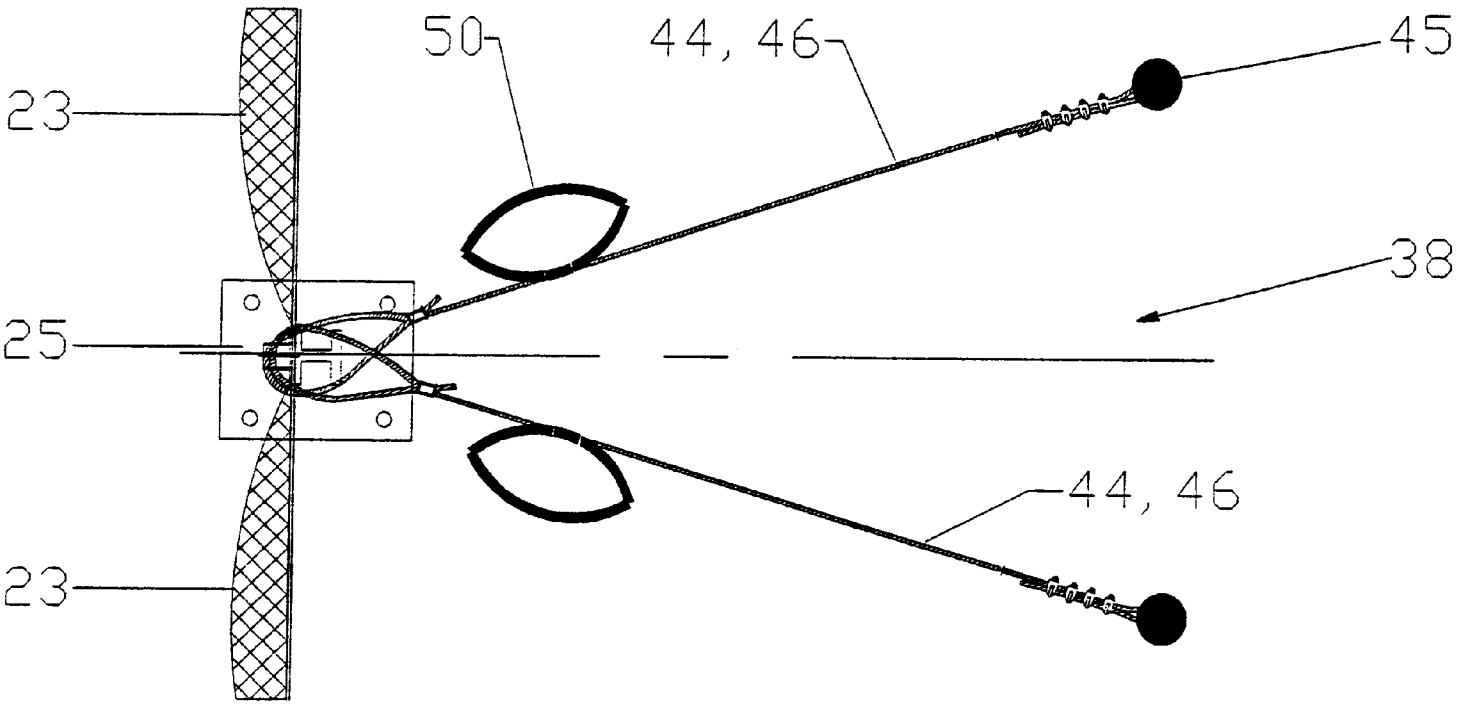

The columns 25 are furthermore supported by various ropes, especially wire ropes, as well as anchor means, which are all collectively referred to as bracing means. In particular, as illustrated in FIGS. 2 and 5*b*, the end columns 25 are braced by lateral bracing means 37, which absorb the major force. In addition, as shown in FIGS. 5*a*, 5*b*, 6*a* and 6*b*, all of the columns 25 are braced by uphill bracing means 38. Each of the lateral bracing means 37 comprises a rope or bracing cable 40 that extends from the top of an end column 25 to the anchor means 41. The bracing cable 40 can be secured to the top of the column 25 in any convenient manner, for example to the guide means 29 or to any other convenient securing means. A further rope or bracing cable 42 extends from the bottom of the end column 25, where it is secured in any convenient manner to the anchor means 41. Similarly, the uphill bracing means 38 comprises a rope or bracing cable 44 that extends from the top of a respective column 25 to an anchor means 45. Furthermore, a rope or bracing cable 46 extends from the bottom of each of the columns 25 to the anchor means 45.

Pursuant to one preferred specific embodiment of the inventive safety net system 20, as illustrated in FIGS. 5 and 6, the lateral bracing means 37 comprises two sets of top and bottom bracing cables 40, 42, and the uphill bracing means 38 also comprises two sets of top and bottom bracing cables 44, 46. As indicated previously, the lateral bracing means 37 are disposed only at the end columns 25, whereas the uphill bracing means 38 are disposed on all of the columns 25. It should also be noted that instead of having two sets of the appropriate bracing cables for the lateral bracing means 37 and the uphill bracing means 38, it would also be possible to have only a single set of top and bottom bracing cables. In particular, if the lateral bracing means 37 can be disposed within 15° of a plane that extends parallel to the plane of the adjacent net panel 23, it would be possible to provide only a single top bracing cable 40 and bottom bracing cable 42, as shown for example in FIG. 2. Similarly, if the uphill bracing means 38 can be disposed within 15° of a plane extending perpendicular to the plane formed by the net panels 23 that adjoin the pertaining column 25, it would be possible to provide only a single top bracing cable 44 and bottom bracing cable 46. It should also be noted that even if two sets of respective bracing cables are utilized, such bracing cables could either extend within 15° or less of the respective plane, but in any case should preferably extend at an angle of no greater than 45° relative to the pertaining plane. At angles greater than 15° two sets of bracing cables are preferred in order to absorb bending moments in the columns 25.

Possible constructions for the anchor means 41 and 45 will now be described in conjunction with FIG. 2, which illustrates the lateral anchor means 41. For example, such anchor means can comprise a wire rope anchor that together with a preferably splayed end is anchored in concrete poured into a hole in the ground 24. The anchor means 41 also has a loop end; the ends of the top and bottom bracing cables 40, 42 are looped through the preferably reinforced loop end of the anchor means 41 and are then connected to themselves, for example by wire rope clips, with four such clips 48 being illustrated in FIG. 2. It should also be noted that the anchor means 41 could be a solid steel type anchor, which is advantageously used in easy-to-drill ground. With such an anchor, the loop end is formed or otherwise attached to a threaded bolt that is then screwed into the ground or into a hole that has been drilled in the ground. Further details concerning the construction of such anchors can be found in the aforementioned patents to Thommen, which patents are hereby incorporated into this disclosure by this reference thereto.

Figure 7:
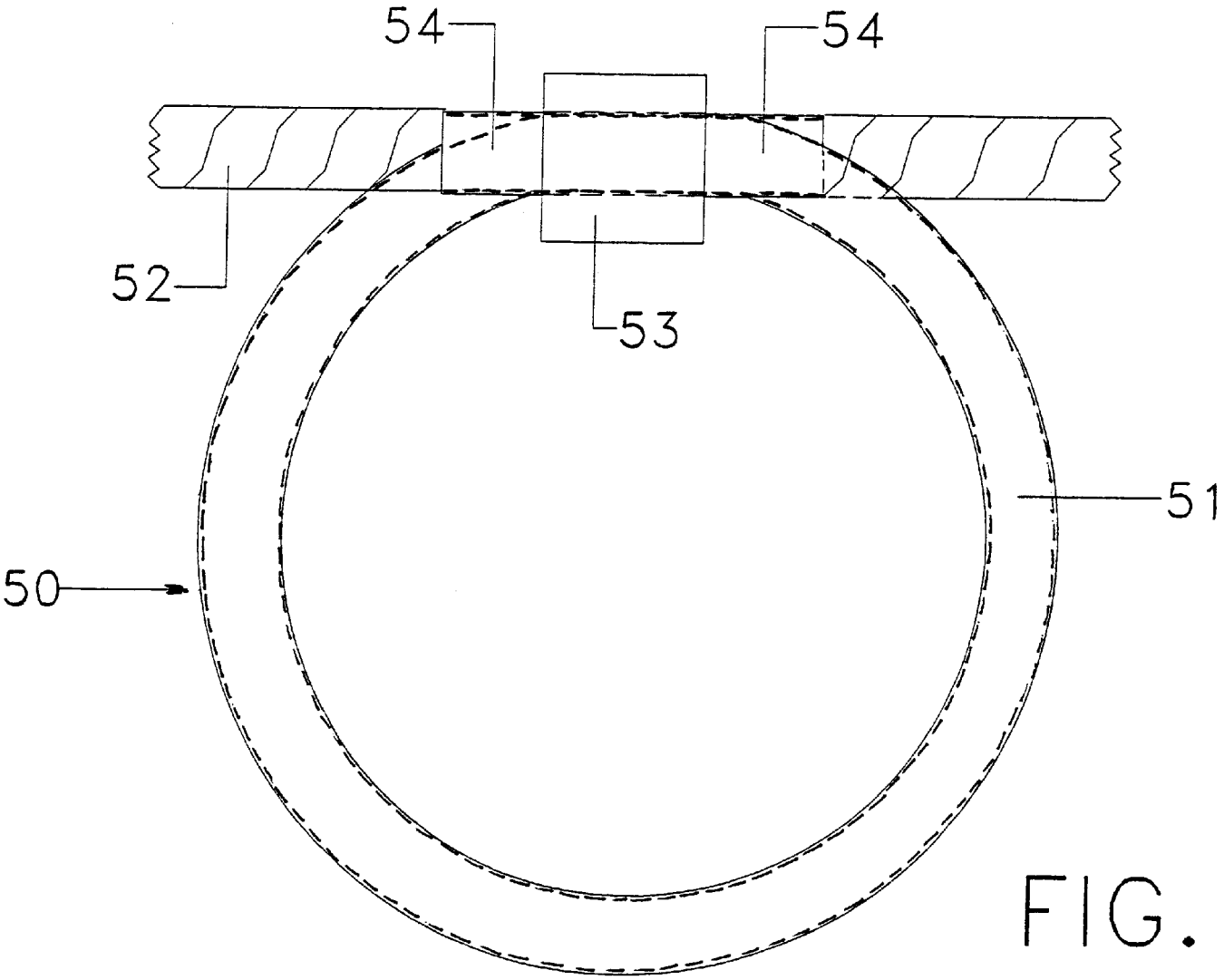
FIG. 7 is a detailed view of the brake element or load-absorbing means of the inventive safety net system.

Another key feature of the inventive safety net system 20 is its ability to absorb high loads without destroying the system. In particular, various elements of the safety net system 20 are provided with brake elements or load-absorbing means 50. The load-absorbing means 50 are disposed in particular on the top rope 27 and the bottom rope 28. As can be seen in FIGS. 1–3, four such load-absorbing means are associated with each of the net panels 23, and should be disposed within three feet of the center line of the adjacent column 25. In addition, it is expedient to provide such load-absorbing means on both the top and bottom bracing cables 44, 46 of the uphill bracing means 38. Load-absorbing means 50 can also be provided on the top and bottom bracing cables 40, 42 of the lateral bracing means 37. The load-absorbing means 50 can, for example, be in the form of a friction brake or dampening means, and as shown in FIG. 7 comprises a tube 51, for example a one inch ID galvanized tube, that is formed in an open loop or ring, with overlapping ends 54. A rope or cable 52, such as the top or bottom ropes 27, 28, or one of the bracing cables 40, 42, 44 or 46, is passed through the tube or ring 51*b* The ends 54 of the tubular ring 51 are then clamped together by means of a clamp or stop sleeve 53, which can be press-fitted on the tube and provide frictional engagement of the tube with the rope or cable 52. The load-absorbing means 50 disposed along the top and bottom ropes 27, 28 allow the net panels 23 to absorb the impact of mud and debris. In particular, the net panels 23 can bulge or deflect with the aid of the load-absorbing means 50, which operate by having the tube 51 decrease in diameter when a predetermined kinetic load is applied to the pertaining top or bottom rope 27, 28. The load-absorbing means 50 in the bracing cables 44, 46 of the uphill bracing means 38 dampen the force that might otherwise cause the columns 25 to shear off, for example by shearing of the bolt 55 that is disposed at the base of the column 25 (see FIG. 4). Load-absorbing means 50 in the bracing cables 40, 42 of the lateral bracing means 37 help to keep the columns 25 from being pulled inwardly toward one another when the safety net system 20 is restraining a mud and debris slide. It should be noted that the columns 25 are preferably a break-away assembly, for example by means of the aforementioned shearing bolt 55.

The net panels 23 are secured to the top and bottom ropes 27, 28 by seam ropes 57 only, i.e. without the use of clips that restrict movement (see in particular FIGS. 2 and 3). The ends of the seam ropes 57 are clipped together by wire rope clips 58. As can also be seen from FIGS. 2 and 3, adjacent net panels 23 are seamed together by the seam ropes 57 that secure the net panels 23 to the top and bottom ropes 27, 28. It should be noted that the net panels 23 are never seamed to the columns 25, with the seam ropes 57 therefore being disposed on only one side of the column, namely the downhill side of the safety net system 20.

Figure 8:
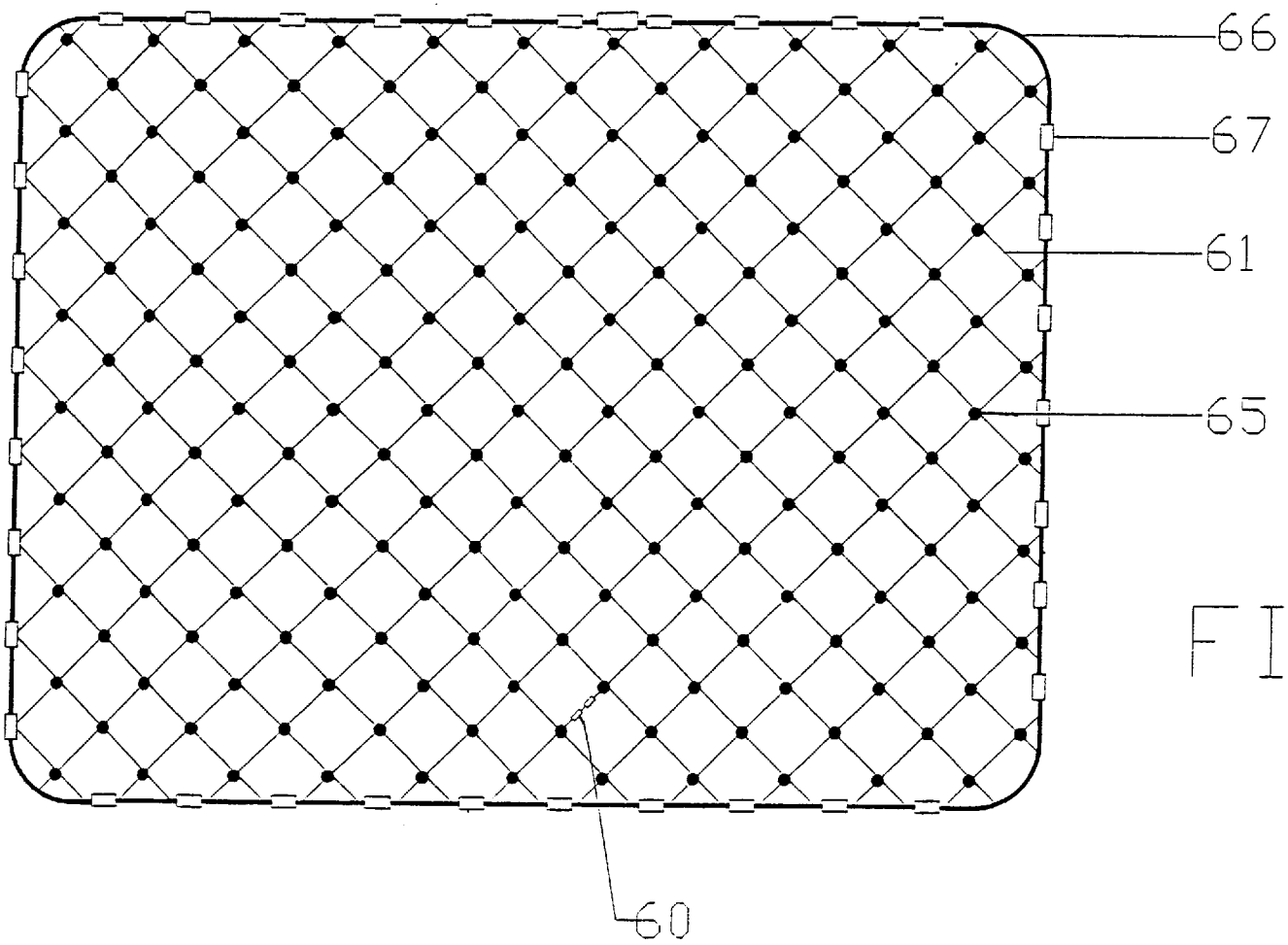
FIGS. 8–10 show various embodiments and layers of a net panel of the inventive safety net system.
Figure 9:
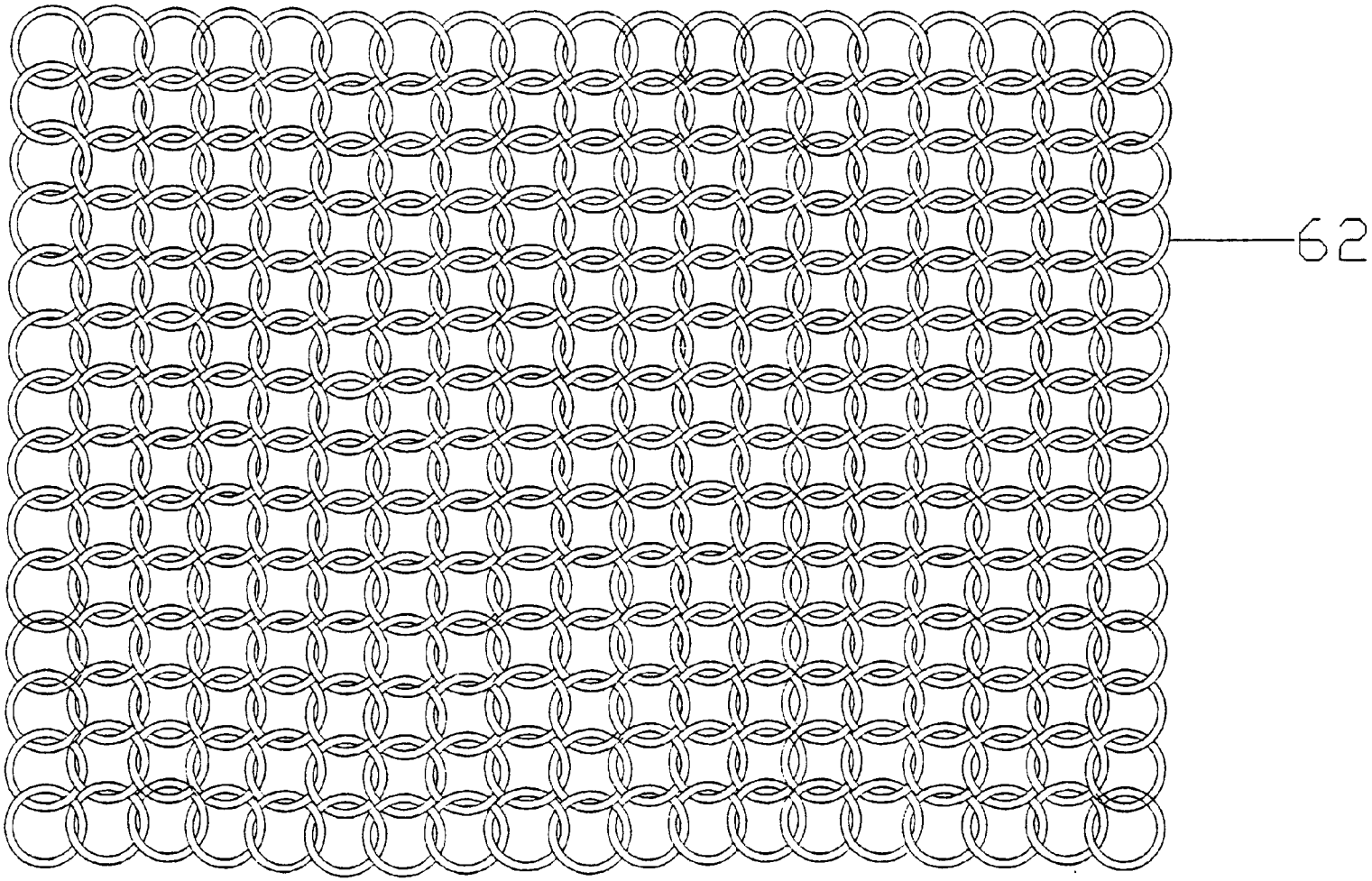

As indicated previously, each of the net panels 23 comprises a woven netting, for example a woven 8 inch by 8 inch diagonal weave mesh netting made from a single wire rope having only a single joint, as indicated by the reference numeral 60 in FIG. 8. This joint 60 can, for example, be in the form of a stop sleeve. In addition to the woven netting 61 shown in FIG. 8, other forms of netting are also possible, such as the ring net 62 shown in FIG. 9, wherein the rings have, by way of example only, a diameter of twelve inches and are made of a ⅜ or ½ inch cable, or a diameter of sixteen inches and are made of a ¾ inch cable. In the embodiment of FIG. 8, the wire rope 64 can, in one specific embodiment of the present invention, have a diameter of 5/16 of an inch. In addition, intersecting portions of the wire rope 64 are secured to one another by clips, for example the cross clips 65 indicated in FIG. 8. The netting is then clipped to a border rope 66, for example via C-clamps 67; the border rope can, for example, have a diameter of ⅝ of an inch. The thus completed net panel 23 is then seamed to the top and bottom ropes 27, 28 by the seam ropes 57, which as indicated also seam a given net panel 23 to an adjacent net panel if one is present. Again, it should be emphasized that the seam ropes 57 engage only other wire ropes, such as the border rope 66 and the top and bottom ropes 27, 28, and do not seam the net panels 23 to the columns 25.

The top and bottom ropes 27, 28, as well as the seam ropes 57 and the border rope 66, are preferably wire ropes. By way of example, the top and bottom ropes 27, 28 can be of ¾ inch diameter, while the seam ropes 57 can have a diameter of 5/16 of an inch.

Figure 10:
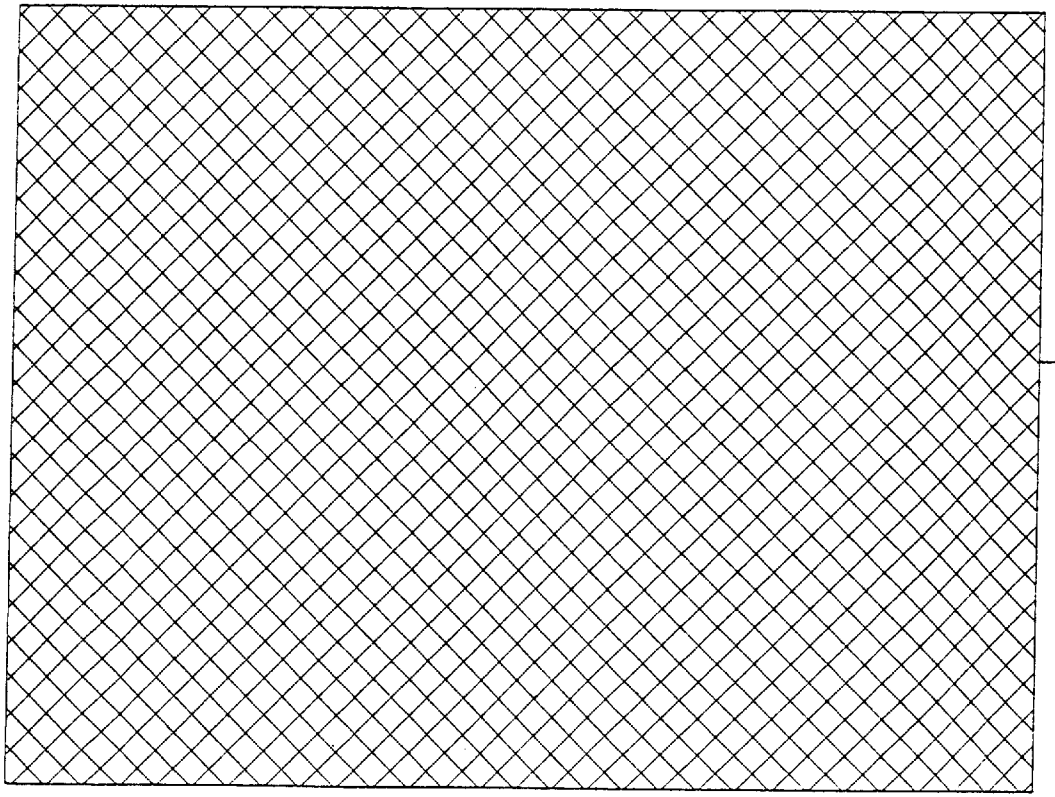

The net panels 23 also have a layered configuration, as shown in FIG. 3. In addition to the woven netting 61 or ring net 62, disposed on the first or uphill side of the netting is a chain link fencing 70, such as an eleven gauge galvanized chain link, also known as a railing fabric, having a diagonal configuration and a mesh size of 1 inch by 1 inch (see FIG. 10). The chain link fencing 70 is secured to the wire rope netting, for example by hog rings. This smaller mesh chain link fencing 70 not only helps to retain smaller material, but also aids in better distributing the impact load to the wire rope netting of the panels 23. It is furthermore possible to optionally provide a silt screen fabric, such a very fine-meshed plastic fabric, or chicken wire, on the first or uphill side of the chain link railing fabric 70; such an optional silt fabric 71 is illustrated in FIG. 3.

As indicated previously, each unit 22 of the inventive safety net system 20 comprises at least one net panel 23; a typical length of such a net panel could be 20 feet, with a typical height of such a net panel 23, which can also vary depending upon need, being, for example, 10 feet. Each unit 22 can also comprise a plurality of net panels 23, whereby a given unit 22 preferably has a length of no greater than 100 feet. Several abutting units 22 can also be provided. In such a case, the adjacent units 22 could have their facing end net panels 23 abut one another, and could even share a common column 25 (see FIG. 1). In such a situation, the adjacent end panels 23 could be seamed together via the seamed ropes 57, as previously discussed in conjunction with adjacent net panels 23 as illustrated in FIGS. 2 and 3. In addition, the lateral bracing means 37 of each of the units 22 overlaps the end net panel 23 of the adjacent unit 22. As can be seen from FIG. 1, the anchor means 41 for the bracing cables 40, 42 of the lateral bracing means 37 can be anchored in the ground 24 in several ways. For example, as shown for the left hand overlapping lateral bracing means 37, the anchor means 41 can share a hole with the column 25 that is disposed at the far left end of the overlapped end net panel 23 of the adjacent unit 22, and is imbedded in the same concrete as is this column 25 or the anchor means 41 thereof. Alternatively, as shown in conjunction with the right hand overlapping lateral bracing means 37, the anchor means 41 is preferably anchored in concrete provided in a separate hole.

The present invention is, of course, in no way restricted to the specific disclosure of the specification and drawings, but also encompasses any modifications within the scope of the appended claims.

What I claim is:

1. A safety net system placed upright on the ground for restraining debris and mud slides, said system including at least one unit, each of which comprises:

at least two columns disposed at least indirectly in the ground, with each column being provided with first guide means near an upper end thereof, wherein said unit includes a respective one of said columns at each of two ends of said unit;

a continuous top rope that extends from a bottom end of one of said end columns of said unit, through said first guide means of said one end column, through respective ones of said first guide means of any interposed columns, through said first guide means of the other of said end columns, to a bottom end of said other of said end columns;

a continuous bottom rope that extends from said bottom end of said one end column through respective second guide means provided near a bottom end of any interposed columns, to said bottom end of said other of said end columns;

at least one net panel, each panel being disposed between two of said columns and being secured to said top and bottom ropes;

at least one anchor means disposed laterally of each of said end columns;

at least one further anchor means angled away from a plane parrllel to the at least one net panel; and respective bracing cables that extend from said upper and bottom ends of each of said end columns to said anchor means that are disposed laterally, and further respective bracing cables that extend from said upper and bottom ends of each of said columns to said further anchor means.

2. A safety net system according to claim 1, wherein load-absorbing means are disposed on both said top rope and said bottom rope.

3. A safety net system according to claim 2, wherein for a given one of said net panels, two load-absorbing means are disposed on said top rope and two load-absorbing means are disposed on said bottom rope.

4. A safety net system according to claim 3, wherein each of said load-absorbing means is disposed within three feet of a center line of an adjacent one of said columns.

5. A safety net system according to claim 2, wherein further load-absorbing means are disposed on said bracing cables that extend from said upper and bottom ends of each of said columns to said further anchor means.

6. A safety net system according to claim 5, wherein further load-absorbing means are disposed on said bracing cables that extend from said upper and bottom ends of each of said end columns to said anchor means that are disposed laterally.

7. A safety net system according to claim 6, wherein each of said load-absorbing means comprises a tubular ring through which one of said ropes or bracing cables extends, with ends of said tubular ring being held together with a clamp that provides frictional engagement of said ring with said rope or bracing cable.

8. A safety net system according to claim 5, wherein two bracing cables extend from both said upper and bottom ends of each of columns to two further anchor means.

9. A safety net system according to claim 8, wherein two bracing cables extend from both said upper and bottom ends of each of said end columns to two anchor means that are disposed laterally.

10. A safety net system according to claim 2, wherein lateral ones of said bracing cables extend within 0–45° of a plane of said adjacent net panel, and the further ones of said bracing cables extend within 0–45° of a plane that extends perpendicular to said adjacent net panels.

11. A safety net system according to claim 2, wherein seam ropes are provided to effect said securement of said at least one net panel to said top and bottom ropes.

12. A safety net system according to claim 2, wherein said anchor means and said further anchor means respectively comprise a wire rope anchor that is disposed in the ground and has a loop end to which said bracing cables are connected.

13. A safety net system according to claim 2, wherein said top rope, said bottom rope, and said bracing cables are wire ropes.

14. A safety net system according to claim 2, wherein each of said net panels comprises a first layer having a larger net mesh, and a second layer of smaller mesh secured to an first side of said first layer.

15. A safety net system according to claim 14, wherein said first layer is a diagonal woven rope netting or a ring net, and said second layer is a chain link fencing.

16. A safety net system according to claim 15, wherein a third layer of fine screen material is secured to an first side of said second layer.

17. A safety net system according to claim 2, wherein each of said units thereof comprises a plurality of said net panels.

18. A safety net system according to claim 17, wherein adjacent ones of said net panels are seamed together via seam ropes but are not seamed to an adjacent one of said columns.

19. A safety net system according to claim 18, which comprises at least two units.

20. A safety net system according to claim 19, wherein ends of said units are disposed adjacent to one another and share a common one of said columns, and wherein said bracing cables that extend laterally from one of said units overlap one of said net panels of an adjacent one of said units.

* * * * *